US006250772B1

(12) United States Patent
Entrop et al.

(10) Patent No.: US 6,250,772 B1
(45) Date of Patent: Jun. 26, 2001

(54) LUMINAIRE WITH TRANSVERSELY MOVABLE LAMP SUPPORT

(75) Inventors: Jean P. Entrop; Hendrik Wijbenga, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/358,062

(22) Filed: Jul. 21, 1999

(30) Foreign Application Priority Data

Jul. 23, 1998 (EP) ..... 98202481

(51) Int. Cl.[7] ..... F21S 4/00

(52) U.S. Cl. ..... 362/225; 362/223; 362/291; 362/342; 362/220; 362/372

(58) Field of Search ..... 362/225, 223, 362/217, 290, 292, 342, 354, 298, 220, 238, 250, 372

(56) References Cited

U.S. PATENT DOCUMENTS

| | | | | |
|---|---|---|---|---|
| 3,909,100 | * | 9/1975 | Hodge, Jr. | 439/238 |
| 4,420,798 | * | 12/1983 | Herst et al. | 362/147 |
| 4,866,584 | | 9/1989 | Plewman | 362/225 |
| 5,806,972 | * | 9/1998 | Kaiser et al. | 362/290 |
| 5,855,427 | * | 1/1999 | Lassovsky | 362/283 |
| 6,109,766 | * | 8/2000 | Baliozian | 362/287 |

FOREIGN PATENT DOCUMENTS

| | | | |
|---|---|---|---|
| 3129689 | 2/1983 | (DE) | F21V/11/02 |
| 0638764 | 6/1996 | (EP) | F21V/7/00 |
| 2301176 | 11/1996 | (GB) | F21V/11/06 |

* cited by examiner

*Primary Examiner*—Alan Cariaso
*Assistant Examiner*—Ronald E. DelGizzi
(74) *Attorney, Agent, or Firm*—Dicran Halajian

(57) ABSTRACT

The luminaire has an elongate concave reflector (1) defining a light-emission window (2), supports 3) for positioning electrical fluorescent tubes (4, 5) and a row of lamellae (6) in the light-emission window (2). A prismatic reflector element (7) extends in the longitudinal direction of the reflector (1) and has its base (72) in the light-emission window (2) and its top (71) next to the fluorescent tubes (4, 5). The luminaire, when mounted to a ceiling, can suitably be used to illuminate vertical surfaces, while the floor is illuminated to a smaller extent only.

9 Claims, 2 Drawing Sheets

LUMINAIRE WITH TRANSVERSELY MOVABLE LAMP SUPPORT

BACKGROUND OF THE INVENTION

The invention relates to a luminaire comprising:

a concave reflector with a longitudinal direction, a light-emission window and a plane of symmetry S extending in the longitudinal direction and transversely to the light-emission window;

means for incorporating in the reflector, along the light-emission window, a first electrical fluorescent tube and a second electrical fluorescent tube;

lamellae in the light-emission window, which extend transversely thereto and transversely to the longitudinal direction of the reflector.

Such a luminaire is disclosed in EP-B-0 638 764.

The known luminaire is a twin luminaire, in which both reflectors accommodate a compact fluorescent lamp having two parallel fluorescent tubes. The lamps are each arranged such that both tubes extend in the relevant plane of symmetry. Both parts of the luminaire illuminate a surface right below the luminaire, which is mounted in or to a ceiling. Each one of the two reflectors is provided with a slit at the side of the relevant lamp, allowing a part of the light generated to be guided from the luminaire to the exterior via auxiliary reflectors situated at the side of the (main) reflector. A transparent prism may be arranged in the path of the light so as to laterally deflect the light.

The known luminaire has the drawback that it has a relatively large width dimension and that its construction is relatively complicated. The luminaire is provided with transparent prisms, causing the luminaire to cast a part of the light in the direction of the ceiling. Without prisms, the auxiliary reflectors increase the light-emission window, however, in that case the light beam is used entirely to illuminate a horizontal surface, such as the floor or a worktop. Vertical surfaces are poorly lit and, in addition, at places relatively close to the ground.

SUMMARY OF THE INVENTION

It is an object of the invention to provide a luminaire which is of a simple construction and can suitably be used to illuminate surfaces extending transversely to the light-emission window.

In accordance with the invention, this object is achieved by positioning the first electrical fluorescent tube and the second electrical fluorescent tube on either side of the plane of symmetry;

a predominantly prismatic reflector element having a top, a base and sides facing the reflector is present, which reflector element extends in the plane of symmetry S, the base being situated close to the light-emission window, and the top being situated close to the fluorescent tubes.

If the luminaire is mounted in or to a ceiling, then the luminaire illuminates, through reflections at a side face of the prismatic element, relatively high parts of a nearby, first vertical surface, while the part of the reflector situated opposite said side face illuminates relatively low parts of said surface. The other side face of the prismatic element, and the part of the reflector opposite said side face, illuminate a second vertical surface situated opposite the first surface. The floor area below the luminaire is in fact only lit to a small degree, predominantly by rays leaving the luminaire without previous reflection at the reflector and the prismatic element.

The reflector also screens the fluorescent tubes in directions transverse to the tubes, so that the tubes are invisible from a chosen angle with the ceiling. The lamellae have a similar function in the longitudinal direction of the reflector and in directions around the longitudinal direction.

The luminaire in accordance with the invention can very suitably be used to illuminate articles in, for example, racks, cupboards, shelves, etc., in, for example, storehouses, shops and libraries.

In a favorable embodiment, the side faces of the prismatic reflector element are concave in the direction from the base to the top. In particular, the side faces have flat strips which are situated between bending lines extending along the light-emission window. By virtue thereof, the prismatic element provides for an improved light distribution and for illumination at higher places.

Favorably, the side faces near the top are substantially parallel, and the means for accommodating the fluorescent tubes can be moved in a direction transverse to the light-emission window. This embodiment has the advantage that the prismatic element can readily extend between the tubes. By virtue of the movability of the means, the luminaire can be adapted to local conditions. If the means are moved towards the light-emission window, then the light flux towards relatively high places is increased. In this case, the prismatic element between the tubes counteracts a reduction of the angle with the ceiling at which the tubes are invisible. Said shape of the prismatic reflector element is also favorable, however, if the means cannot be moved.

In a favorable embodiment, the reflector has flat strips which are interconnected along bending lines extending parallel to the light-emission window. This embodiment has the advantage that the light reflected by the reflector is spread more over the relatively low parts of a vertical surface.

In a variant, the reflector has a convex bending line in the plane of symmetry. This has the advantage that also the top-of the reflector contributes to the illumination of a vertical surface.

It is favorable if cylindrical end reflectors end the row of lamellae, said reflectors having an axis which extends along the light-emission window. By virtue thereof, the light emitted by the tubes in their longitudinal direction is effectively used.

In an advantageous embodiment, the reflector is divided into a plane P along the light-emission window, at some distance from the lamellae. This embodiment enables the lamellae and the prismatic element to be interconnected so as to form an inextricable unit, while the fluorescent tubes can still be readily exchanged by removing said unit.

The reflector, the lamellae and the prismatic element may be manufactured from a lacquered material, for example a plate material. Alternatively, they are made of a reflective metal, such as aluminium or an alloy thereof. They may be mat, mirror-bright or semi-bright. If the lamellae are bright, they are preferably prismatic with their top in the light-emission window. The lamellae then preferably have concave, for example parabolic side faces, in order to deflect incident light downward.

The fluorescent tubes may each be a fluorescent lamp or jointly constitute the limbs of one compact fluorescent lamp.

These and other aspects of the invention will be apparent from and elucidated with reference to the embodiments described hereinafter.

DETAILED DESCRIPTION OF THE PREFERRED EMBODIMENTS

Figure 1:
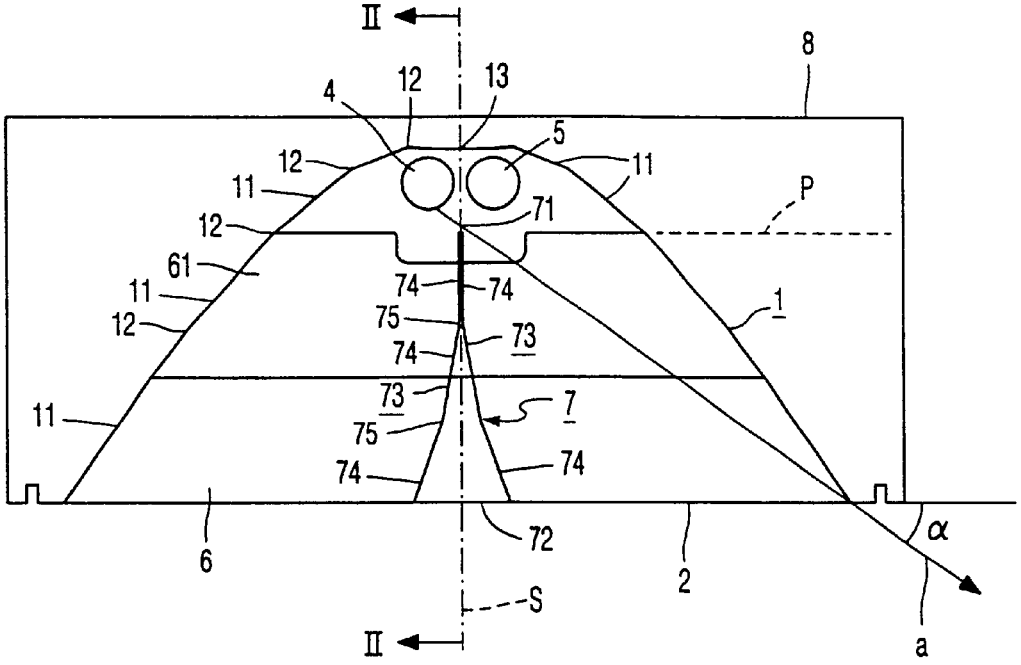
FIG. 1 is a cross-sectional view transverse to the longitudinal direction of the reflector, at the location of the center of the longitudinal direction.
Figure 2:
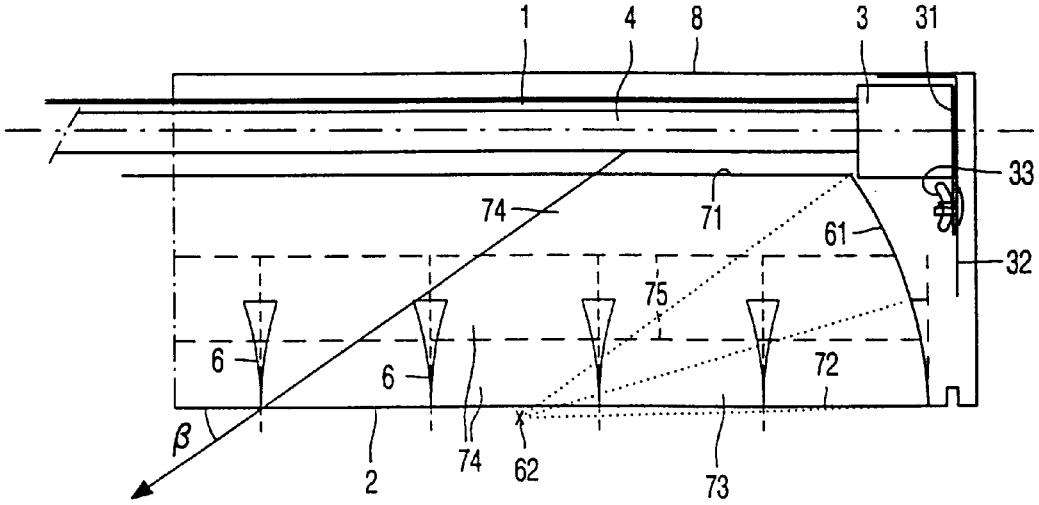
FIG. 2 is a longitudinal sectional view taken on the line II—II in FIG. 1.

In FIGS. 1 and 2, the luminaire has a concave reflector 1 extending in a longitudinal direction (see FIG. 2), a light-emission window 2, and a plane of symmetry S in the longitudinal direction, transverse to the light-emission window 2. Supports 3 are provided by means of which a first electrical fluorescent tube 4 and a second electrical fluorescent tube 5 are supported in the reflector 1 along the light-emission window 2. A row of lamellae 6 is situated in the light-emission window 2. The lamellae 6 extend transversely to the light-emission window 2 and transversely to the longitudinal direction of the reflector 1. The lamellae 6 shown are prismatic, their top being situated in the light-emission window 2. The side faces of the lamellae are parabolically concave.

The first and the second electrical fluorescent tube 4 and 5, respectively, are accommodated on either side of the plane of symmetry S. A predominantly prismatic reflector element 7 having a top 71, a base 72 and side faces 73 facing the reflector 1 is provided, which reflector element extends in the plane of symmetry S, the base 72 being situated close to the light-emission window 2 and the top 71 being situated close to the fluorescent tubes 4, 5.

The reflector 1 determines, in a direction transverse to the longitudinal direction of the reflector 1, the angle $\alpha$ with respect to a ceiling, which is the angle at which the tubes 4 and 5 are invisible. Also the prismatic reflector element 7 contributes, in the drawing, to this angle (FIG. 1). The lamellae 6 determine the angle $\beta$ with respect to the ceiling, which is the angle at which the tubes 4 and 5 are invisible in the longitudinal direction of the reflector 1 (FIG. 2). In the drawing, the angles $\alpha$ and $\beta$ are equally large.

The side faces 73 of the prismatic reflector element 7 are concave in the direction from the base 72 to the top 71. In the drawing, the side faces have flat strips 74 which extend between bending lines 75 extending along the light-emission window 2.

Close to the top 71, the side faces 73 are substantially parallel, i.e. they lie at least substantially against each other (see FIG. 1), and the means 3 for incorporating the fluorescent tubes 4, 5 can be moved transversely to the light-emission window 2. For this purpose, the supports 3 are provided with a strip 31, and the housing 8 has a bracket 32, which are detachably interconnected by supports of a nut and bolt 33. If it is desirable to emit more light to relatively high places, the supports 3 can be moved towards the light-emission window. In this case, the prismatic reflector element 7 will be situated with its top 71 between the tubes 4 and 5. FIG. 1 shows that a downward movement of the prismatic reflector element 7 does not influence the size of the angle $\alpha$ until tube 5 touches the light ray a shown. This movement does not affect the angle $\beta$ either. Only if the supports 3 are moved further, the angle $\alpha$ is reduced.

In the embodiment shown, the reflector 1 has flat strips 11 which are interconnected along bending lines 12 extending parallel to the light-emission window 2.

The reflector 1 has a convex bending line 13 in the plane of symmetry S.

The row of lamellae 6 ends with cylindrical end reflectors 61 having an axis 62 which extends along the light-emission window 2, which axis 62 is situated outside the luminaire in the embodiment shown.

The reflector 1 is divided into a plane P along the light-emission window 2, at some distance from the lamellae 6. The part of the reflector 1 which is situated close to the light-emission window 2, the lamellae 6 and the prismatic reflector element 7 jointly constitute a unit.

In the drawing, the reflector 1, the lamellae 6 and the prismatic reflector element 7 are made of semi-bright aluminium. The fluorescent tubes 4 and 5 jointly form a compact fluorescent lamp having a base on one side, which lamp consumes, for example, 55 W, and the lamp cap is accommodated in the means 3 shown.

Figure 3:
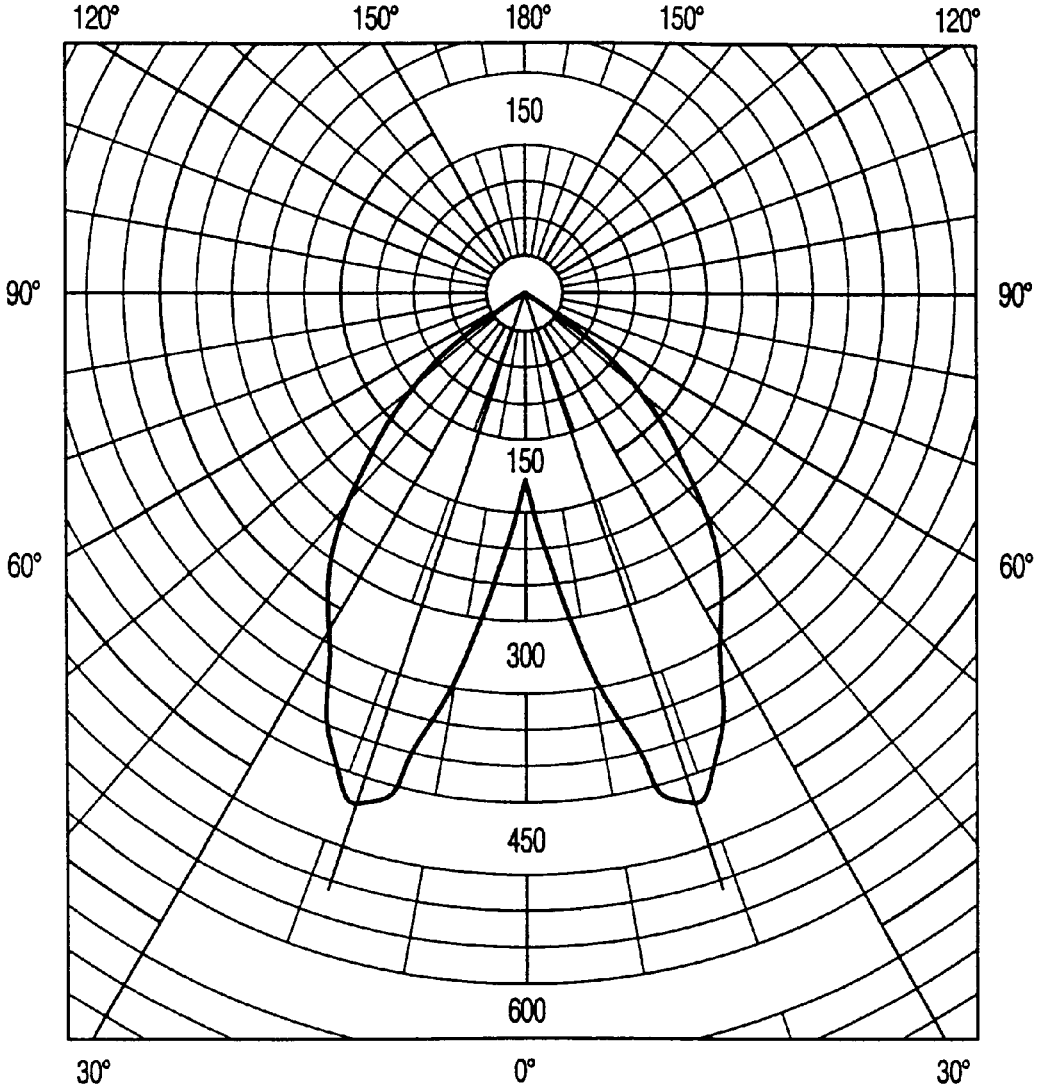
FIG. 3 is an intensity diagram in the plane of section of FIG. 1.

FIG. 3 shows that the light beams formed from the light generated by each of the two fluorescent tubes is directed sideways. The maxima of the light beams include an angle of approximately 38° with each other. The intensity in the center of the Figure, i.e. right below the luminaire arranged in or to a ceiling, is small.

What is claimed is:

1. A luminaire comprising:

a concave reflector with a longitudinal direction, a light-emission window and a plane of symmetry S extending in the longitudinal direction and transversely to the light-emission window (2);

support means for positioning in the reflector, along the light-emission window, a first fluorescent tube and a second fluorescent tube on either side of the plane of symmetry S, the support means for positioning the fluorescent tubes being movable in a direction transverse to the light-emission window;

lamellae in the light-emission window, which extend transversely thereto and transversely to the longitudinal direction of the reflector; and a predominantly prismatic reflector element having a top, a base and sides facing the reflector, which reflector element extends in the plane of symmetry S, the base being situated close to the light-emission window, and the top being situated close to the fluorescent tubes.

2. A luminaire as claimed in claim 1, wherein the sides of the prismatic reflector element are concave in the direction from the base to the top.

3. A luminaire as claimed in claim 2, wherein the sides have flat strips which are situated between bending lines extending along the light-emission window.

4. A luminaire as claimed in claim 2 wherein the sides near the top are substantially parallel.

5. A luminaire as claimed in claim 1 wherein the concave reflector has flat strips which are interconnected along bending lines extending parallel to the light-emission window.

6. A luminaire as claimed in claim 5, wherein the concave reflector has a convex bending line in the plane of symmetry S.

7. A luminaire as claimed in claim 1 further comprising cylindrical end reflectors extending in the longitudinal direction on either said of said lamellae, said end reflectors having an axis which extends along the light-emission window.

8. A luminaire as claimed in claim 1 wherein the concave reflector is divided into a plane P along the light-emission window at some distance from the lamellae.

9. A luminaire comprising:

a housing;

a first reflector located in said housing along a longitudinal direction;

a light-emission window located at one of said first reflector;

a holder connected to said housing, said holder holding two adjacent fluorescent lamps on either side of a plane of symmetry extending in the longitudinal direction, wherein the holder is movable between a top of said housing and said light-emission window; and a second reflector which extends in the plane of symmetry said second reflector having a base which is near the light-emission window and a top which is situated near the fluorescent lamps.

* * * * *